United States Patent [19]

Wong et al.

[11] Patent Number: 4,965,868

[45] Date of Patent: Oct. 23, 1990

[54] ELECTROMAGNETIC POLARIZATION SELECTOR

[75] Inventors: Mon N. Wong, Torrance; Gregory D. Kroupa, Hawthorne, both, Calif.

[73] Assignee: Hughes Aircraft Company, Los Angeles, Calif.

[21] Appl. No.: 365,391

[22] Filed: Jun. 13, 1989

[51] Int. Cl.[5] ..... H01Q 13/00; H01P 1/17

[52] U.S. Cl. ..... 343/756; 333/21 A; 333/117; 343/772

[58] Field of Search ..... 333/108, 111, 113, 21 A, 333/105, 117; 343/756, 772, 909, 797

[56] References Cited

U.S. PATENT DOCUMENTS

| | | | |
|---|---|---|---|
| 2,948,863 | 8/1960 | Honda | 333/10 |
| 3,995,239 | 11/1976 | Head et al. | 333/21 R |
| 4,158,183 | 6/1979 | Wong et al. | 333/21 A |
| 4,691,177 | 9/1987 | Wong et al. | 333/113 |
| 4,710,734 | 12/1987 | Sterns | 333/101 |
| 4,812,788 | 3/1989 | Wong et al. | 333/113 |
| 4,818,964 | 4/1989 | Wong | 333/111 |

*Primary Examiner*—Rolf Hille
*Assistant Examiner*—Peter Toby Brown
*Attorney, Agent, or Firm*—Robert A. Westerlund; Steven M. Mitchell; W. K. Denson-Low

[57] ABSTRACT

A polarization selector system, suitable for use with an antenna for radiating electromagnetic waves at a variety of preselectable polarizations, is formed of an orthogonal mode launcher of electromagnetic waves, and a hybrid coupling assembly for driving the launcher. The coupling assembly has a pair of waveguides sharing a common wall. A set of hybrid couplers of differing coupling ratios, and including a mechanically displaceable gate within each coupler, is disposed serially along the common wall.

The gates are individually positionable to provide for coupling of differing amounts of electromagnetic power with 90 degree phase shift between the waveguides. Output signals of the waveguides connect with respective ones of a pair of mode launching probe assemblies in the mode launcher to energize the probe assemblies for producing a resulting electromagnetic wave having selectively right and left hand circular or elliptical polarization as well as linear polarization which can be advanced in orientation in increments of ninety degrees.

5 Claims, 5 Drawing Sheets

ELECTROMAGNETIC POLARIZATION SELECTOR

BACKGROUND OF THE INVENTION

This invention relates to apparatus for launching electromagnetic waves in any one of a plurality of modes of polarization and, more particularly, to a system for electrically selecting a desired mode of polarization.

In the processing of electromagnetic signals, it is frequently desirable to combine signals of various phases and polarizations to produce a resultant signal having a desired polarization. A typical example of such signal processing occurs in the generation of a circularly polarized electromagnetic wave radiated from an antenna. It is common practice to generate such a circularly polarized wave by combining two component signal waves in phase quadrature and having their electric vectors oriented perpendicularly to each other and to a direction of power flow. An equality in the amplitudes of the two component signals produces a circularly polarized resultant wave, while an inequality in the amplitudes of the two component signals produces an elliptically polarized wave. Interchanging the sine and cosine relationships of the two component waves reverses the direction of the circular or elliptical polarizations. In addition, activation of only one of the component waves produces a resultant linearly polarized wave. In some applications, it is desirable to have the facility to switch from one polarization to another polarization of the resultant outputted electromagnetic wave.

A problem arises in that presently available switching systems for altering the component signals have been limited in the number of possible polarizations which can be selected. The introduction of additional microwave circuitry to provide for the capacity to select additional polarizations for the resultant signal has resulted in an undesirable increase in complexity and physical size to microwave equipment employed in the generation of the resultant signal.

SUMMARY OF THE INVENTION

The foregoing problem is overcome and other advantages are provided by a system for selectively altering the polarization of a resultant electromagnetic wave outputted by the system. It is an object of the invention to construct the system of microwave components which reduce system complexity and which allow selection of linear polarizations as well as circular and elliptical polarizations which may have either a right hand or a left hand sense.

In accordance with the invention, the system includes an orthogonal mode launcher of electromagnetic waves, and a switchable hybrid coupler assembly having a pair of output ports connecting with orthogonal branches of the wave launcher. The coupler assembly is formed of a pair of rectangular waveguides sharing a common narrow wall wherein there is located a series of individually activatable coupling means.

Each of the coupling means is formed as a hybrid coupler introducing a 90 degree phase shift between a first microwave signal in a first of the waveguides and a second microwave signal in a second of the waveguides into which a portion of the radiation has been coupled. Each coupling means is constructed as a rectangular aperture formed in the common wall, and includes a mechanically displaceable gate which extends across the aperture. Both the common wall and the gate are fabricated of electrically conductive material, such as brass or aluminum, which inhibits a coupling of electromagnetic power between the two waveguides when the aperture is closed by the gate. However, upon a displacing of the gate of the aperture, so as to open a passage between the two waveguides, the coupling means becomes activated to couple electromagnetic power between the two waveguides. In accordance with well-known technology in the construction of hybrid couplers, the length of the aperture along the common wall is selected to produce a 3 dB (decibels) coupler for an even division of power between the two waveguides. The aperture may be made smaller in one or more of the couplers to produce an uneven division of power between the two waveguides. The even division allows for the generation of circularly polarized radiation while the uneven division allows for the generation of elliptically polarized radiation. The use of two 3 dB couplers enables transference of all of the microwave power from one of the waveguides to the other of the waveguides. This permits a shifting between right and left hand circularly polarized radiation.

It is noted that the microwave components of the system operate in reciprocal fashion such that the system can be used either for transmission or for the reception of electromagnetic signals. In addition, it is noted that signals inputted to separate ones of the waveguides are isolated from each other so that the two signals can be transmitted independently of each other. Thereby, two separate signals can be generated and received concurrently. For convenience in describing the waveguides, in the ensuing description and in the claims, the terms "input port" and "output port" are employed to identify various ports of the waveguides, it being understood that a port employed as an input port during a transmission mode of the microwave circuitry can serve, alternatively, as an output port during a reception mode of the microwave circuitry. Similarly, the orthogonal mode wave launcher which launches a wave in a transmission mode of the microwave circuitry is understood to receive the wave during a reception mode of the microwave circuitry.

BRIEF DESCRIPTION OF THE DRAWING

The foregoing aspects and other features of the invention are explained in the following description, taken in connection with the accompanying drawing wherein.

DETAILED DESCRIPTION

Figure 1:
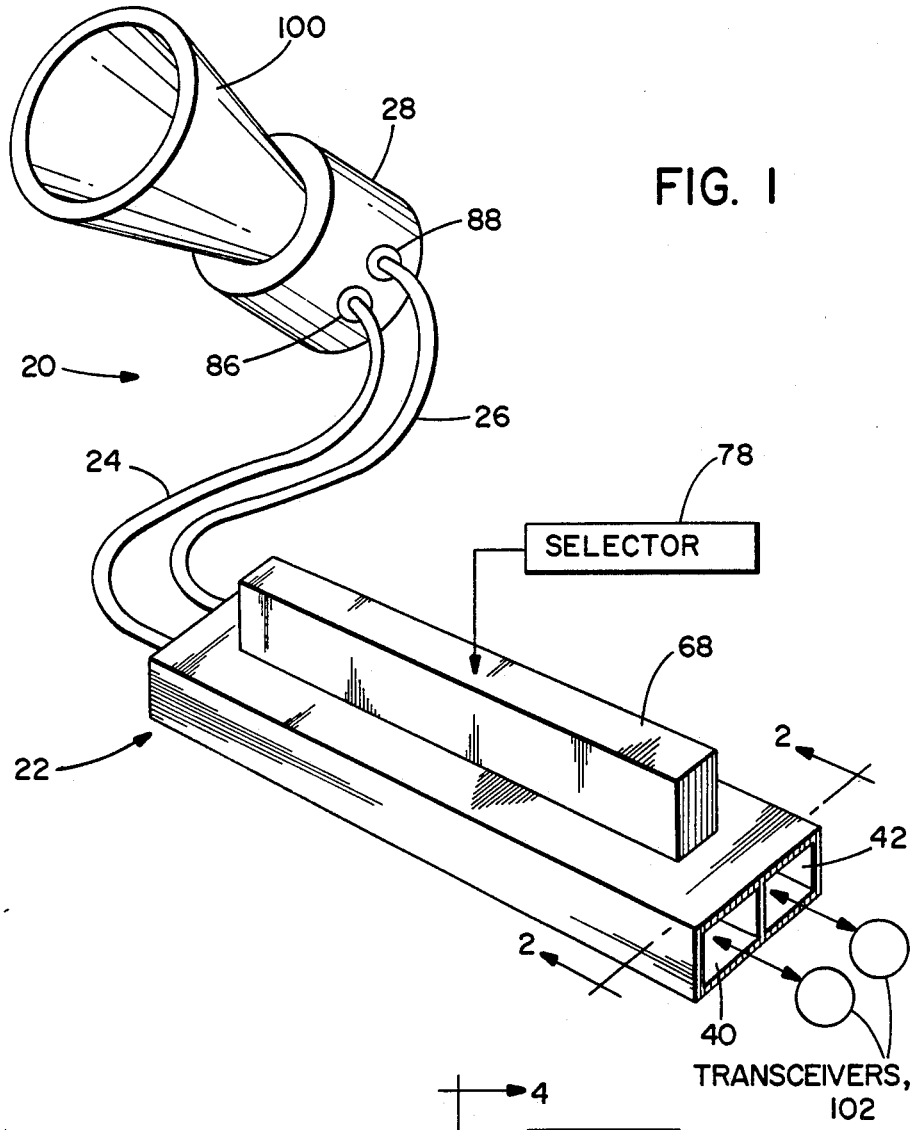
FIG. 1 is a perspective view, partially diagrammatic, of a polarization selector of the invention wherein a switchable microwave coupler assembly drives an orthogonal mode wave launcher.
Figure 2:
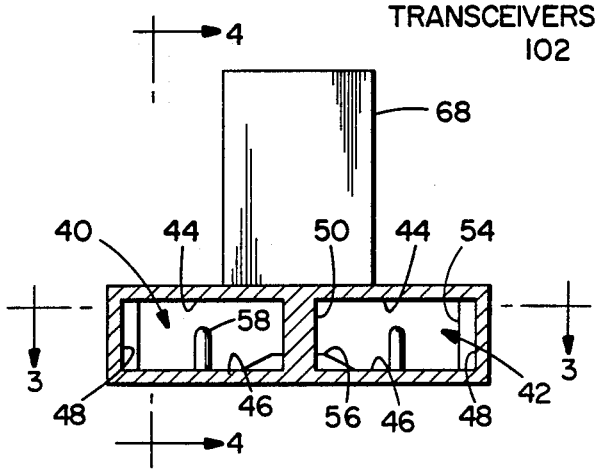
FIG. 2 is an end view of the coupler assembly taken along the line 2—2 in FIG. 1.
Figure 3:
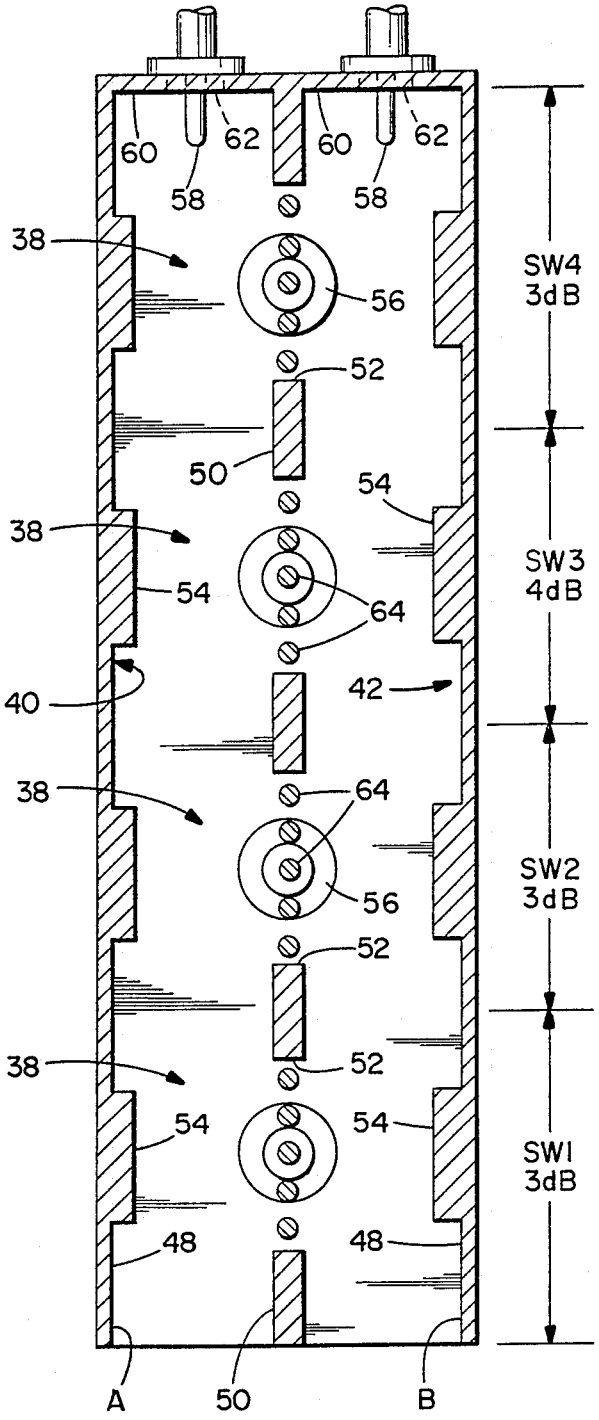
FIG. 3 is a sectional view of the coupler assembly taken along the line 3—3 in FIG. 2.
Figure 5:
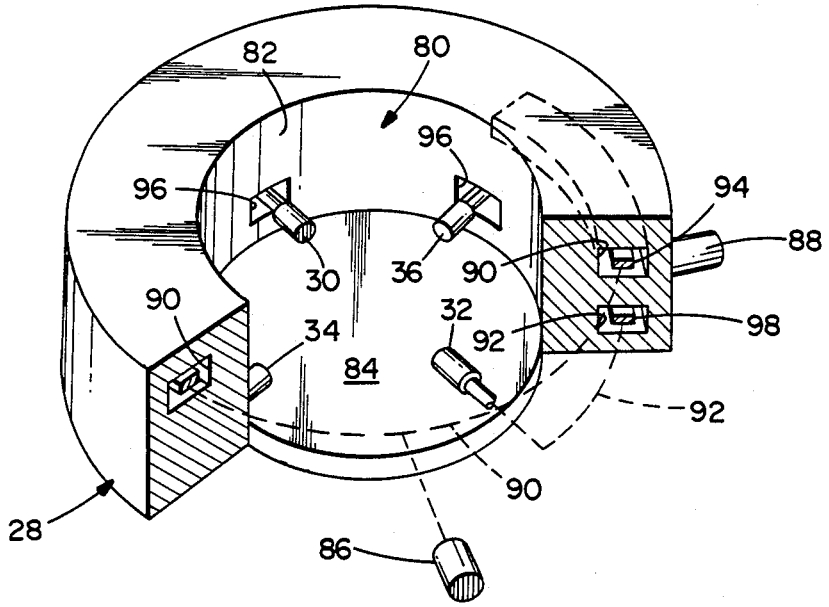
FIG. 5 is a perspective view, partially cut-away, of a wave launcher of FIG. 1, portions of FIG. 5 being shown diagrammatically to indicate microwave transmission lines.

With reference to FIG. 1, there is shown a polarization selector system 20, which, in accordance with the invention, comprises a switchable microwave hybrid-coupler assembly 22 connected via transmission lines 24 and 26, such as coaxial cables, to an orthogonal-mode wave-launcher 28. The launcher 28 comprises a first and a second mode launching means which, as shown in FIG. 5, may be, respectively, a first set of diametrically opposed probes 30 and 32, and a second set of diametrically opposed probes 34 and 36. Construction of the wave launcher 28 is to be described briefly herein, it being understood that further details in the construction of the launcher 28 are provided in U.S. Pat. No. 4,158,183 issued in the name of M. N. Wong et al on June 12, 1979, the contents of which are incorporated herein by reference, The coupler assembly 22, as shown in FIG. 3, comprises a set of four switchable hybrid couplers 38 constructed within a pair of waveguides 40 and 42 with individual ones of the switchable couplers 38 being identified further by the legends SW1–SW4. Details in the construction of the couplers 38 are to be provided herein, it being understood that further details in the construction and operation of the couplers 38 are provided in U.S. Pat. No. 4,691,177 issued in the name of M. N. Wong et al issued Sept. 1, 1987, the contents of which are incorporated herein by reference.

With reference to FIGS. 1–4, each of the waveguides 40 and 42 of the coupler assembly 22 have a rectangular cross section, and comprises a top wall 44 and a bottom wall 46. The top and the bottom walls 44 and 46 serve as broad walls of the waveguide 40 and 42, and are joined together by narrow outer sidewalls and a common inner sidewall 50. The sidewall 50 is disposed along a center line of the assembly 22.

Each of the couplers 38 is formed as a rectangular aperture 52 within the sidewall 50, the aperture 52 extending between top and bottom walls 44 and 46 for communicating between the waveguides 40 and 42. To facilitate a description of the assembly 22, the left side of the assembly 22 containing the waveguide 40 is designated as the "A" side, and the right side of the assembly 22 containing the waveguide 42 is designated as the "B" side. In accordance with well-known principles of construction of hybrid couplers, the length of each of the apertures 52 along the sidewall 50 is dependent on the amount of electromagnetic power to be coupled by the aperture. By way of example, in the case of the switchable couplers, SW1, SW2, and SW4, these couplers are 3 dB couplers for coupling one-half of the power between the waveguides 40 and 42; accordingly, the corresponding apertures 52 extend a distance of approximately one free-space wavelength or three-quarter guide-wavelength along the common sidewall 50. The switchable coupler SW3 is a 4 dB coupler for coupling a lesser amount of power between the waveguides 40 and 42; accordingly, the aperture 52 of the coupler SW3 has a shorter length than the apertures of the other couplers. The apertures 52, as depicted in FIG. 3, are not shown to scale so as to facilitate construction of the drawing. Also included within each of the couplers 38 is a pair of abutments 54 disposed in the outer sidewalls 48 and a button 56 disposed on the bottom wall 46 centrally within the aperture 52 to enhance coupling of microwave power with minimal standing-wave ratio.

Coupling of power from either of the waveguides 40 and 42 to the corresponding transmission line 24 and 26 is provided by a coupling loop 58 disposed in the forward end of each of the waveguides 40 and 42. The coupling loop 58 serves as an H-plane waveguide to coaxial transmission-line transition. Each loop 50 passes through a front shorting wall 60 of the waveguides 40, 42, and connects with the bottom wall 46 at a distance of approximately one-quarter guide-wavelength from the front wall 60. Each loop 58 is insulated from the front wall 60 by a ring 62 of insulating material. The loops 58, upon passing out of the waveguides 40 and 42 via the front wall 60 connect with center conductors (not shown) of the coaxial transmission lines 24 and 26.

Figure 4:
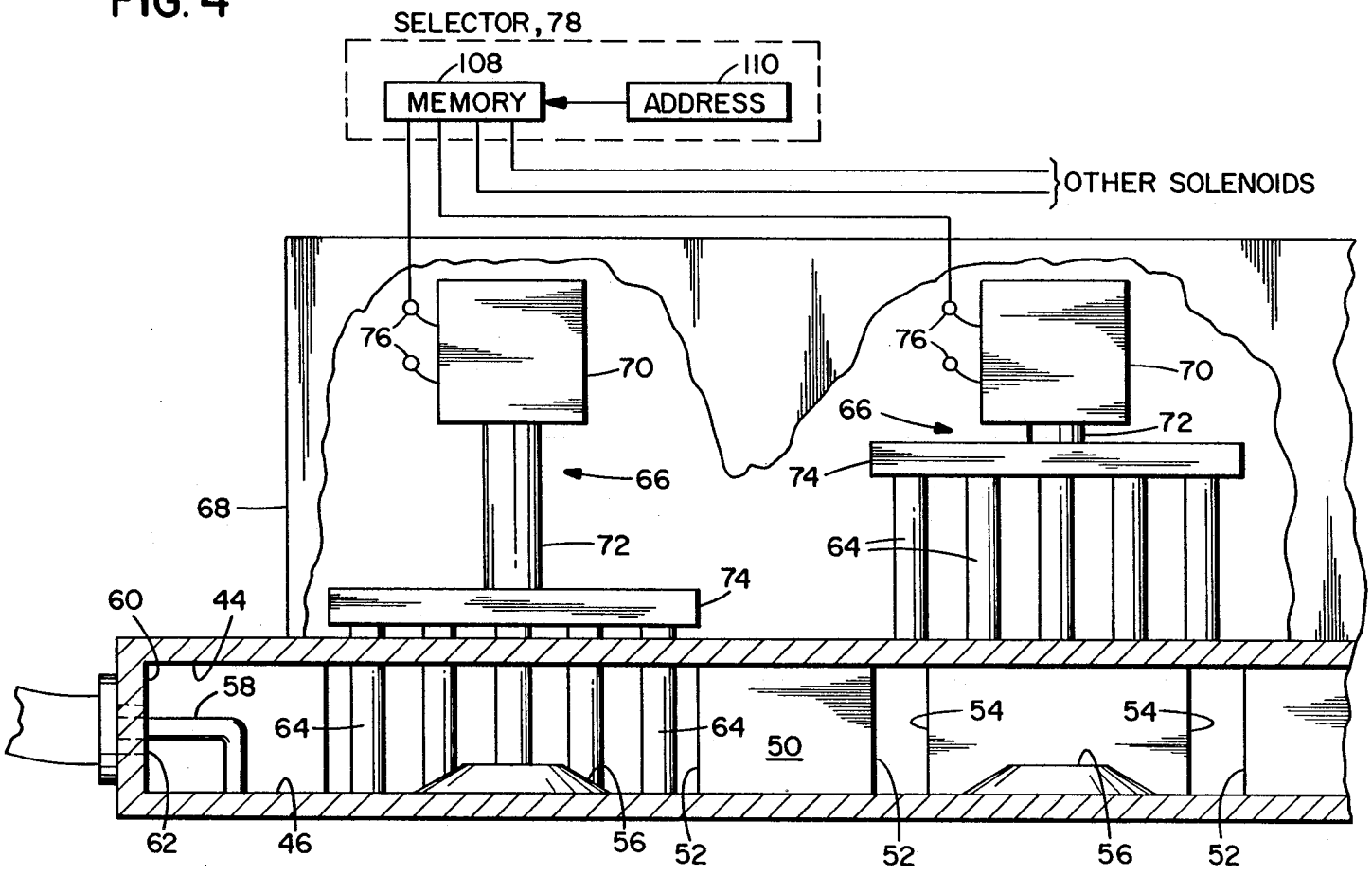
FIG. 4 is a sectional view of the coupler assembly taken along the line 4—4 in FIG. 2, a portion of the coupler assembly being shown cut away to disclose switching apparatus.

A switching function is provided to each of the couplers 38 by a set of parallel rods 64 extending in displaceable fashion between the top wall 44 and the bottom wall 46, there being one set of rods 54 for each of the couplers 38. By way of example, five rods 64 may be employed in each of the couplers 38 to serve as a gate for opening and closing the coupler. The middle rod of each set of rods 64 is aligned with the center of each button 56. The rods 54 are spaced sufficiently close together to ensure that essentially no microwave power couples between the waveguides 40 and 42 at any one of the couplers 48 when the rods 64 close the aperture 52 of the coupler. An array of electromechanical actuators 66, two of which are shown in FIG. 4, are located within a housing 68 and connect with respective sets of the rods 64 in the respective switchable couplers 38. Each of the actuators 66 comprises a solenoid 70 having a movable plunger 72 connecting with a brace 74 which, in turn, supports a set of the rods 64 which extend downwardly from the brace 74.

The housing 68 sits on the top wall 44 of each of the waveguides 40 and 42, and is centered on the common sidewall 50. The rods 64 pass through apertures (not shown) in the top wall 44 so as to extend into the respective apertures 52 of the sidewall 50 upon a downward movement of the brace 74 and the plunger 72. Each solenoid 70 is provided with terminals 76 which connect electrically to a selector 78 (FIG. 1) which provides electric current to respective ones of the solenoids 70 for activating the solenoids 70 to drive the rods 64 up or down. In the up position of the rod 64, in any one of the couplers 38, the aperture 52 is open to allow for passage of electromagnetic power between the waveguides 40 and 42. With the rods 64 in a down position in any one of the couplers 38, the aperture 52 of that coupler is closed to prevent a flow of electromagnetic power between the waveguides 40 and 42.

By way of alternative embodiment of the coupler assembly 22, it is noted that the H-plane transition embodied by the coupling loop 58 may be replaced with an E-plane transition (not shown) embodied by a probe extending from a center conductor of a coaxial transmission line through one of the broad walls of the waveguide 40, 42 at a distance of approximately one-quarter guide-wavelength from the front wall 60, and extending approximately halfway between the two broad walls. Also, the housing 68 with the actuator 66 therein may be mounted upon the top wall as shown in FIG. 4 or, alternatively, may be mounted upon the bottom wall as disclosed in FIG. 4 of the aforementioned U. S. Pat. No. 4,691,177.

The waveguides 40 and 42 are constructed of electrically conductive material, particularly a metal such as brass or aluminum. Similarly, the rods 64 are constructed of a metal such as brass or aluminum. In the preferred embodiment of the invention, the ratio of width of a broad wall to a narrow sidewall in either of the waveguides 40, 42 is 2:1.

With reference to FIGS. 1 and 5, the wave launcher 28 is formed as a cylindrical chamber 80 defined by a cylindrical wall 82 closed off by a bottom plate 84. Both the wall 82 and the plate 84 are formed of electrically conductive material, such as brass or aluminum. The probes 30, 32, 34, and 36 extend from the wall 82 towards a central axis of the chamber 80 and are disposed in a common plane spaced-apart from and parallel to the plate 84. Included within the launcher 28 are ports 86 and 88 connecting respectively with the transmission lines 24 and 26.

The wall 82 is sufficiently thick to encompass two coaxial transmission lines 90 and 92 connected respectively to the ports 86 and 88. Opposite ends of the transmission line 90 connect with the probes 34 and 36. Opposite ends of the transmission line 92 connect with the probes 30 and 32. Both of the transmission lines 90 and 92 are only partly visible in FIG. 5, with portions of the transmission lines being indicated diagrammatically by dashed lines. Each of the transmission lines 90 and 92 is constructed with an outer conductor formed as a square coaxial and an inner conductor formed as a rod suspended within the outer conductor and insulated therefrom by vanes (not shown) of insulating dielectric material such as plastic. The center conductor 94 of the transmission line 90 passes through an aperture 96 in the wall 82 to connect directly with the probe 36, the opposite end of the center conductor 94 exiting through another aperture 96 (not visible in FIG. 5) to connect directly with the probe 34. In the transmission line 92, the center conductor 98 extends through an aperture 96 of the wall 82 to connect directly with the probe 30, and at an opposite terminus of the center conductor 98, extends through a further aperture 96 (not visible in FIG. 5) to connect directly with the probe 32. The two transmission lines 90 and 92 are offset from each other in a direction parallel to the axis of the chamber 80 and have arms, indicated by dashed lines, extending in radial and axial directions of the chamber 80 to terminate in the common plane of the probes 30, 32, 34, and 36 for making the foregoing connections with the probes.

The launcher 28 can provide linear polarization with the electric field extending between the probes 34 and 36, or linear polarization with the electric field extending between the probes 30 and 32. Alternatively, the electric vector can be made to rotate either clockwise or counterclockwise to produce a circularly polarized radiation in the event that equal amplitude signals appear on all four of the probes 30–36, or elliptically polarized radiation in the event that the signal strength at the probes 34 and 36 differs from the signal strength at the probes 30 and 32. The launching of electromagnetic waves with any of the foregoing polarizations is most useful in the case of the energization of an antenna for transmission of the electromagnetic waves. By way of example a horn antenna 100, as shown in FIG. 1, is mounted to the launcher 28 in communication with the chamber 80. Signals to be radiated by the horn antenna 100 may be provided by transceivers 102 connected to input ports of the waveguides 40 and 42. The microwave components of the system 20 operate in reciprocal fashion so that signals received by the horn antenna 100 are communicated via the launcher 28 and the coupler assembly 22 to the transceivers 102. The microwave circuitry of the system 102 allows the transceivers 102 to operate independently of each other so that either or both of the transceivers 102 may be operated as a transmitter or a receiver independently of the presence of the other transceiver 102.

The operation of the system 20 for accomplishing the foregoing modes of radiation is explained with reference to FIGS. 6–11. These figures indicate diagrammatically interconnection of the probes 30 and 32 via transmission lines 92 and 26 to the B side of the coupler assembly 22, and interconnection of the probes 34 and 36 via transmission lines 90 and 24 to the A side of the coupler assembly 22. In the preferred embodiment of the invention, both of the transmission lines 24 and 26 are of the same electric length so as to introduce no differential phase shift between the set of probes 30 and 32 and the set of probes 34 and 36. The electrical length of the transmission line 90 is sufficiently long to allow for connection of the transmission line 24 at a location 104 which is closer to the probes 34 than the probe 36, and wherein the difference in electrical lengths between the location 104 and each of the probes 34 and 36 provides for a difference in phase shift of 180 degrees between signals at the probes 34 and 36. Similarly, the electrical length of the transmission line 92 is sufficiently great so as to permit interconnection of the lines 92 and 26 at a location 106 which is closer to the probe 32 than to the probe 30, and wherein the difference in electrical lengths between the location 106 and each of the probes 32 and 30 is sufficiently great to produce a phase shift of 180 degrees between the probes 30 and 32.

In FIGS. 6–11, only one of the transceivers 102 (FIG. 1) is employed, the transceiver 102 being coupled to the waveguide 40 on the A side of the coupler assembly 22.

This simplifies the explanation. The B side of the coupler assembly 22 is not energized; however, it is understood that this explanation applies equally well to the energization of the B side of the coupler assembly 22.

Figure 6:
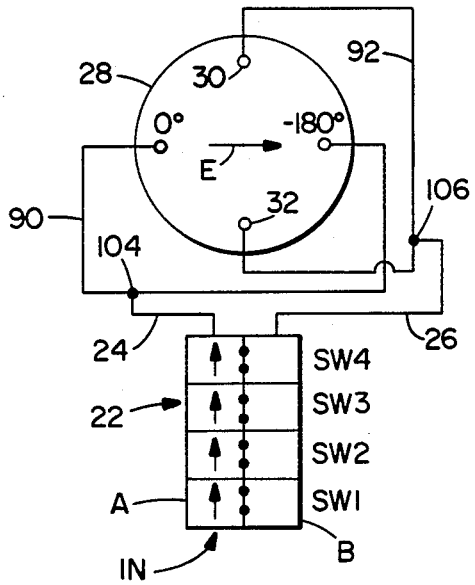
FIGS. 6–11 show polarizations of electric waves produced by the wave launcher of FIG. 1 in response to various combinations of switchable coupling elements of the coupler assembly.

In FIG. 6, all of the rods 64 are down closing off all of the couplers 38 (FIG. 3). Therefore, all of the microwave power inputted at side A travels to the transmission line 24 and then splits evenly between the probes 34 and 36 to produce a resultant electric field, E, which is linearly polarized in the direction shown in FIG. 6.

Figure 7:
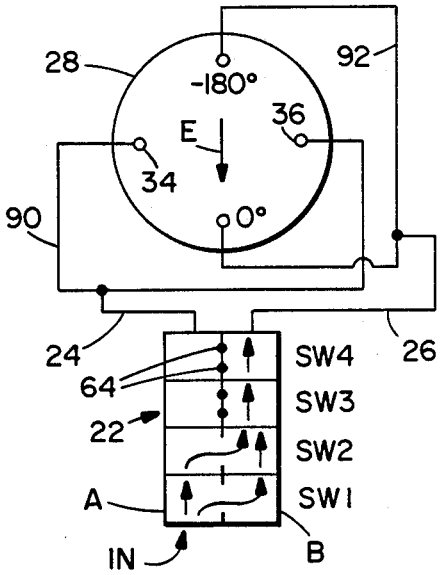

In FIG. 7, the rods 64 of the switchable couplers SW1 and SW2 are raised to allow for a switching of power from the A side to the B side of the coupler assembly 22. In the coupler SW1, half of the power is coupled to the B side with a resultant phase shift of −90 degrees. The remaining half of the power progresses along the A side to the next coupler SW2 wherein the remaining half of the power is coupled over to the B side. It is noted that all of the power must couple to the B side due to the 90 degree phase shift. For example, if one were to consider the possibility of coupling power at coupler SW2 back to the A side, there would be a 180 degree phase shift cancellation. Therefore, all of the power couples from the A side to the B side. As a result, power from the coupler assembly 22 is outputted via the transmission line 26 to the transmission line 92 wherein the power splits evenly between the probes 30 and 32 to produce a resultant electric field, E, which is perpendicular to the direction of the electric field shown in FIG. 6.

Figure 8:
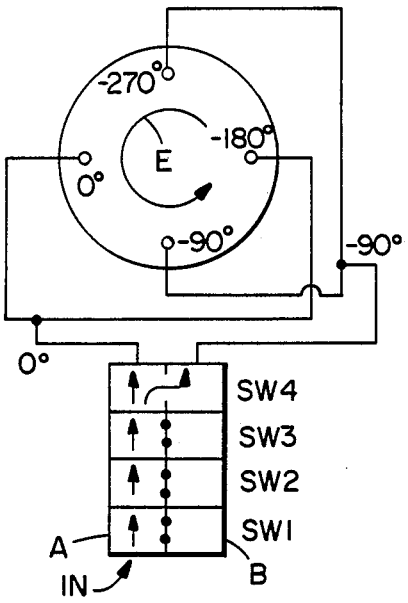

In FIG. 8, the rods of the coupler SW4 are raised to allow for a switching of half of the power from the A side to the B side. Due to the 90 degree phase shift introduced by coupling through the coupler SW4, signals applied to the ports 86 and 88 by the coupler assembly 22 are in phase quadrature, and signals at successive ones of the probes 34, 32, 36, and 30 undergo successive increments of 90 degree phase lag resulting in a counterclockwise circular polarization as viewed along the direction of propagation of radiation from the launcher 2 into the horn antenna 100.

Figure 9:
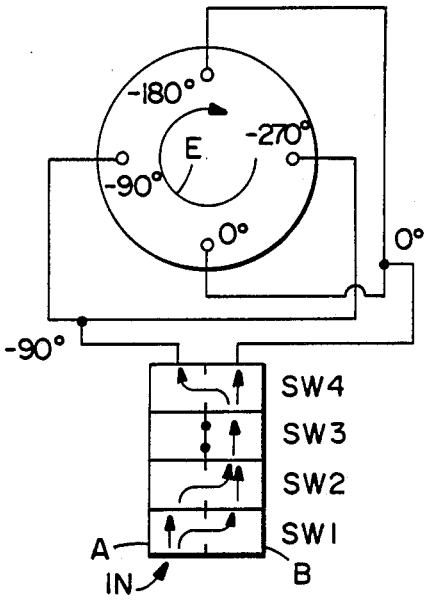

In FIG. 9, the rods 64 of the couplers SW1 and SW2 are raised to allow a switching of power from the A side to the B side. Thereafter, at coupler SW4, the rods 64 are also raised to allow for coupling of half of the power back to the A side. This results in a clockwise circularly polarized radiation propagating out of the launcher 28.

Figure 10:
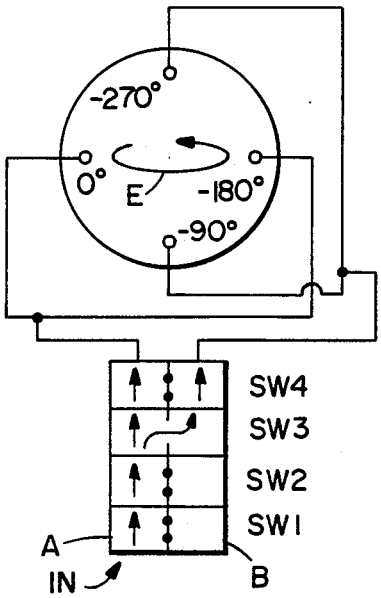

In FIG. 10, all of the couplers are closed except for the coupler SW3 wherein the rods 64 are raised to allow for a coupling of a portion of the electromagnetic power from the A side to the B side of the coupler assembly 22. The amount of power coupled is less than half of the power so that an uneven distribution of power results. The signal strength at the probes 30 and 32 is less than the signal strength at the probes 34 and 36. The result is elliptical polarization in the counterclockwise sense.

Figure 11:
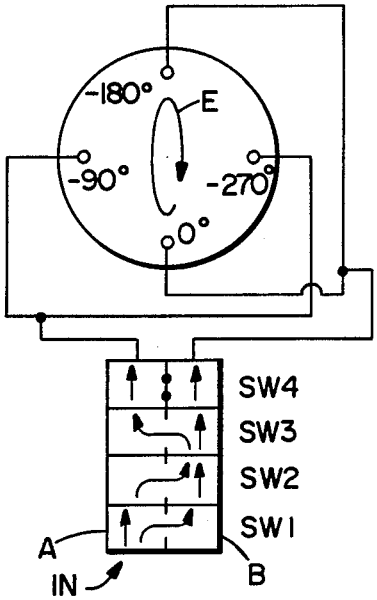

In FIG. 11, the couplers SW1 and SW2 are opened to allow for a crossover of power from the A side to the B side. Thereafter, at the coupler SW3, a portion of the power, less than half the power, is switched back to the A side. This results in an uneven distribution of signal amplitude among the probes to provide elliptical polarization in the clockwise sense.

With each of the forgoing fixed modes of polarization, dual mode operation is possible using both of the transceivers 102 because the set of couplers SW1–SW4 operate to provide for isolation between the input ports to the waveguides 40 and 42, respectively, at the A and the B sides of the coupler assembly 22. The horn antenna 100 may serve as an element of a phased array antenna. In this case, the radiating aperture of the horn antenna may have a diameter of one to two free-space wavelengths for most array antenna applications, with a still larger aperture horn antenna being employed for still higher gain array antennas.

The foregoing description shows that the invention can readily supply a variety of modes of polarization by use of switchable couplers. The switching is conveniently activated electrically by a selector of the polarization. For any one of the desired modes of polarization, the selector 78 (FIG. 1) operates to activate the actuators 66 in accordance with the scheme set forth in FIGS. 6–11 to provide the desired mode of polarization. If desired, the selector 78 can be provided with a read-only memory 108 (FIG. 4) for storing each of the switch configurations of FIGS. 6–11, the memory 108 being addressed by an addressing device 110, such as a digital encoder, so that a requested mode of polarization is implemented by addressing the memory 108 to switch the requisite couplers 38.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A polarization selector system comprising:

a switchable hybrid coupler assembly having two output ports and at least one input port; and a plural mode launcher of electromagnetic waves having two input ports connected to respective ones of the two output ports of said coupler assembly, said mode launcher comprising a first mode launching means and a second mode launching means coupled to respective ones of the input ports of said mode launcher, said first mode launching means producing a first polarization and said second mode launching means producing a second polarization different from said first polarization, said mode launcher combining radiations of both of said mode launching means to produce a resultant polarization; and wherein said coupler assembly comprises a first waveguide and a second waveguide, said first and said second waveguides terminating respectively in a first and a second of the output ports of said coupler assembly;

a plurality of hybrid coupling means arranged serially along said first waveguide and said second waveguide for coupling microwave energy between said first waveguide and said second waveguide; and selection means for selectively activating individual ones of said coupling means to couple microwave energy between said first and said second waveguide, and for selectively deactivating individual ones of said coupling means to inhibit a coupling of microwave energy between said first and said second waveguides; and wherein, in said plurality of coupling means, there are at least two coupling means each of which provides for an equal division of power between said first and said second waveguides, there being a third coupling means providing for an uneven division of power between said first and said second waveguides to provide a resultant elliptical polarization in said mode launcher.

2. A polarization selector system according to claim 1 wherein said plurality of hybrid coupling means includes a fourth coupling means which provides an even division of power between said first waveguide and said second waveguide to produce, at said mode launcher, resultant polarizations including both circular and elliptical polarization of either hand, selectively, and linear polarization of either hand, selectively, and linear polarizations selectively at a plurality of orientations.

3. A polarization selector system according to claim 2 wherein each of said coupling means comprises a passage extending from said first waveguide to said second waveguide for the propagation of electromagnetic power between said first waveguide and said second waveguide, and a gate mechanically displaceable within said passage; and said selection means comprises electromechanical means for displacing the gate to an open position for activating the coupling means to couple power, and for displacing the gate to a closed position for inhibiting a coupling of power between said first waveguide and said second waveguide; and wherein said first and said second mode launching means are positioned perpendicularly to each other to provide said mode launcher with the characteristics of an orthogonal mode launcher upon presentation by said coupling assembly of quadrature signals at the two input ports of said mode launcher.

4. An antenna system providing for selectable polarization comprising:

a horn radiator;

a switchable hybrid coupler assembly having two output ports and at least one input port; and a plural mode launcher of electromagnetic waves having two input ports connected to respective ones of the two output ports of said coupler assembly, said mode launcher comprising a first mode launching means and a second mode launching means coupled to respective ones of the input ports of said mode launcher, said first launching means producing a first polarization and said second launching means producing a second polarization different from said first polarization, said mode launcher combining radiations of both of said launching means to produce a resultant polarization; and wherein said coupler assembly comprises a first waveguide and a second waveguide, said first and said second waveguides terminating respectively in a first and a second of the output ports of said coupler assembly; a plurality of hybrid coupling means arranged serially along said first waveguide and said second waveguide for coupling microwave energy between said first waveguide and said second waveguide; and selection means for selectively activating individual ones of said coupling means to couple microwave energy between said first and said second waveguide, and for selectively deactivating individual ones of said coupling means to inhibit a coupling of microwave energy between said first and said second waveguides; and said mode launcher further comprises a cylindrical housing with an electrically conductive end wall, the housing enclosing said first and second launching means, said horn radiator connecting to an open portion of said housing opposite said end wall for coupling radiation with said resultant polarization from said mode launcher to radiate an electromagnetic wave with said resultant polarization; and, wherein said plurality of coupling means includes three coupling means each of which provides for an even division of electromagnetic power between said first waveguide and said second waveguide, and a fourth coupling means providing for an uneven division of electromagnetic power between said first waveguide and said second waveguide to provide selectively for radiations of both circular and elliptical polarizations of either hand and linear polarizations at plural orientations.

5. An antenna system according to claim 4 wherein each of said coupling means comprises a passage extending from said first waveguide to said second waveguide for the propagation of electromagnetic power between said first waveguide and said second waveguide, and a gate mechanically displaceable within said passage; and said selection means comprises electromechanical means for displacing the gate to an open position for activating the coupling means to couple power, and for displacing the gate to a closed position for inhibiting a coupling of power between said first waveguide and said second waveguide; and wherein said first and said second mode launching means are positioned perpendicularly to each other to provide said mode launcher with the characteristics of an orthogonal mode launcher upon presentation by said coupling assembly of quadrature signals at the two input ports of said mode launcher.

* * * * *